US011071375B2

(12) United States Patent
Leng

(10) Patent No.: US 11,071,375 B2
(45) Date of Patent: Jul. 27, 2021

(54) FOLDING HINGE

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 16/861,270

(22) Filed: Apr. 29, 2020

(65) Prior Publication Data

US 2020/0352319 A1 Nov. 12, 2020

(30) Foreign Application Priority Data

May 6, 2019 (CN) ..... 201920637604.5

(51) Int. Cl.
*A47B 3/00* (2006.01)
*A47B 3/087* (2006.01)
*A47B 13/06* (2006.01)

(52) U.S. Cl.
CPC ..... *A47B 3/087* (2013.01); *A47B 13/06* (2013.01); *A47B 2200/0037* (2013.01)

(58) Field of Classification Search
CPC ..... A47B 3/09; A47B 3/0911; A47B 3/091; A47B 3/0912; A47B 3/087; A47B 13/06; A47B 2200/0037; Y01T 16/545; Y01T 16/5453; Y01T 16/5402; Y01T 16/5403; Y01T 16/5409; Y01T 403/32557; Y01T 403/32393; Y01T 403/32271
USPC ..... 108/160, 125, 129, 131, 132; 248/166, 248/439
See application file for complete search history.

(56) References Cited

U.S. PATENT DOCUMENTS 1,194,310 A * 8/1916 Moe ..... A45D 27/29 248/314
1,446,924 A * 2/1923 Nicholson ..... A47B 3/0912 403/85
1,660,723 A * 2/1928 Robineau ..... A47B 3/0912 108/160
1,785,342 A * 12/1930 Gilbert ..... A47B 3/0912 403/100
3,046,073 A * 7/1962 De Saussure ..... A47B 3/0912 403/113
3,146,737 A * 9/1964 De Saussure ..... A47B 3/0912 108/133
3,180,609 A * 4/1965 Johnson ..... A47B 19/08 248/460

(Continued)

*Primary Examiner* — Janet M Wilkens
(74) *Attorney, Agent, or Firm* — Cooper Legal Group, LLC

(57) ABSTRACT

The present disclosure discloses a folding hinge comprising an inner hinge piece and an outer hinge piece. Top edges of two side plates of the outer hinge piece are connected together by a connecting piece, and a slot is defined between the two side plates. A first end of the inner hinge piece extends into the slot and is pivotally connected to the outer hinge piece. The inner hinge piece comprises a through hole. An end portion of an inner surface of each of the two side plates respectively comprises a convex portion. The two convex portions are disposed to correspond to the through hole, and the two convex portions are clamped together through the through hole when the inner hinge piece and the outer hinge piece are unfolded. An inner surface of each of the two side plates is disposed with a plastic plate.

6 Claims, 4 Drawing Sheets

(56) References Cited

U.S. PATENT DOCUMENTS 3,563,592 A * 2/1971 Preston ..... E05C 17/32
292/263
4,833,754 A * 5/1989 Yang ..... E05D 15/30
16/337
5,509,361 A * 4/1996 Chen ..... A47B 3/0912
108/131

* cited by examiner

FOLDING HINGE

RELATED APPLICATIONS

This application claims priority to Chinese Patent Application 201920637604.5, filed on May 6, 2019. Chinese Patent Application 201920637604.5 is incorporated herein by reference.

FIELD OF THE DISCLOSURE

The present disclosure relates to a folding hinge, and in particular relates to a folding hinge of a table leg.

BACKGROUND OF THE DISCLOSURE

Legs of a folding table are hinged with a frame of the table top to achieve rotational folding of the legs. A support structure is further provided between the legs and the frame of the table top. The support structure provides diagonal support to the legs when the legs are unfolded, therefore preventing the legs from swinging and causing the table top to become unstable.

The existing support structures are roughly divided into two types. One type is a single link, in which one end of the link is rotationally connected to the legs and the other end is slidably connected to the frame of the table top. The link is held in place by a fastener when the folding table is in the unfolded state. The other type is a hinge comprising two hinge pieces. The free ends of the two hinge pieces are respectively rotationally connected to the legs and the frame of the table top. When the two hinge pieces are unfolded, the two hinge pieces are fastened to each other to achieve positioning.

The free end of each hinge piece, the leg, and the frame of the table top are all rotationally connected, and the hinge structure is simpler. However, after the existing hinge is repeatedly unfolded and folded, the fasteners between the two hinge pieces are very worn, resulting in the hinge pieces easily losing their proper positions. Therefore, the service life of the hinge is short.

BRIEF SUMMARY OF THE DISCLOSURE

The present disclosure provides a folding hinge to solve deficiencies of the existing techniques. In order to solve the aforementioned technical problems, a technical solution of the present disclosure is as follows.

A folding hinge comprises an inner hinge piece and an outer hinge piece. The outer hinge piece comprises two side plates bilaterally symmetrically disposed. Top edges of the two side plates are connected together by a connecting piece, and a slot is defined between the two side plates. A first end of the inner hinge piece extends into the slot and is pivotally connected to the outer hinge piece. The inner hinge piece comprises a through hole. An end portion of an inner surface of each of the two side plates respectively comprises a convex portion, and the two convex portions are symmetrically disposed. The two convex portions are disposed to correspond to the through hole, and the two convex portions are clamped together through the through hole so that the inner hinge piece is positioned between the two side plates when the inner hinge piece and the outer hinge piece are unfolded. An inner surface of each of the two side plates is disposed a plastic plate. Each of the two plastic plates comprises a position hole corresponding to a corresponding one of the two convex portions. Each of the two plastic plates at least covers an area where a corresponding one of the two side plates and the inner hinge piece overlap when the inner hinge piece and the outer hinge piece are unfolded.

In a preferred embodiment, a cross-section surface of the outer hinge piece comprises a U-shaped structure.

In a preferred embodiment, a lower edge of each of the two plastic plates comprises a flange extending outward, and the flange is fastened to a bottom edge a corresponding one of the two side plates.

In a preferred embodiment, the two plastic plates are connected together by a plastic top wall, and the two plastic plates and the plastic top wall define an injection-molded integral part.

In a preferred embodiment, an end surface of each of the two plastic plates and an end surface of the plastic top wall facing the inner hinge piece define a stop ring. The stop ring abuts an end face of the outer hinge piece.

In a preferred embodiment, the inner hinge piece is pivotally connected to the outer hinge piece by a rivet.

Compared with existing techniques, the technical solution of the present disclosure has the following advantages.

As inner surfaces of the two side plates are disposed with plastic plates, the inner hinge piece directly contacts the plastic plates during a folding and unfolding process of the inner hinge piece and the outer hinge piece. Only when the through hole on the inner hinge piece is aligned with holes of the plastic plates, are the convex portions clamped together through the through hole. The plastic plates are configured to separate the inner hinge piece and outer hinge piece, which can effectively prevent abrasion between the inner hinge piece and outer hinge piece, reduce resistance force of the inner hinge piece entering the slot, and extend a service life of the products.

BRIEF DESCRIPTION OF THE DRAWING

The present disclosure will be further described below with the combination of the accompanying drawings together with the embodiments.

DETAILED DESCRIPTION OF THE EMBODIMENTS

Embodiment 1

Figure 1:
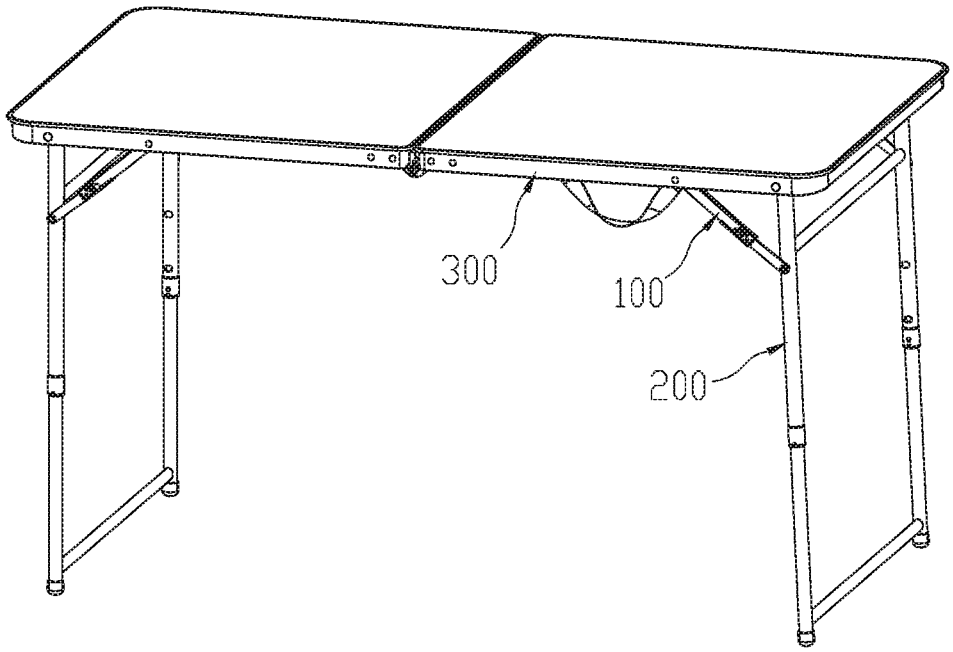
FIG. 1 is a perspective view of a folding hinge connected between a table leg and a table top frame of the present disclosure.
Figure 2:
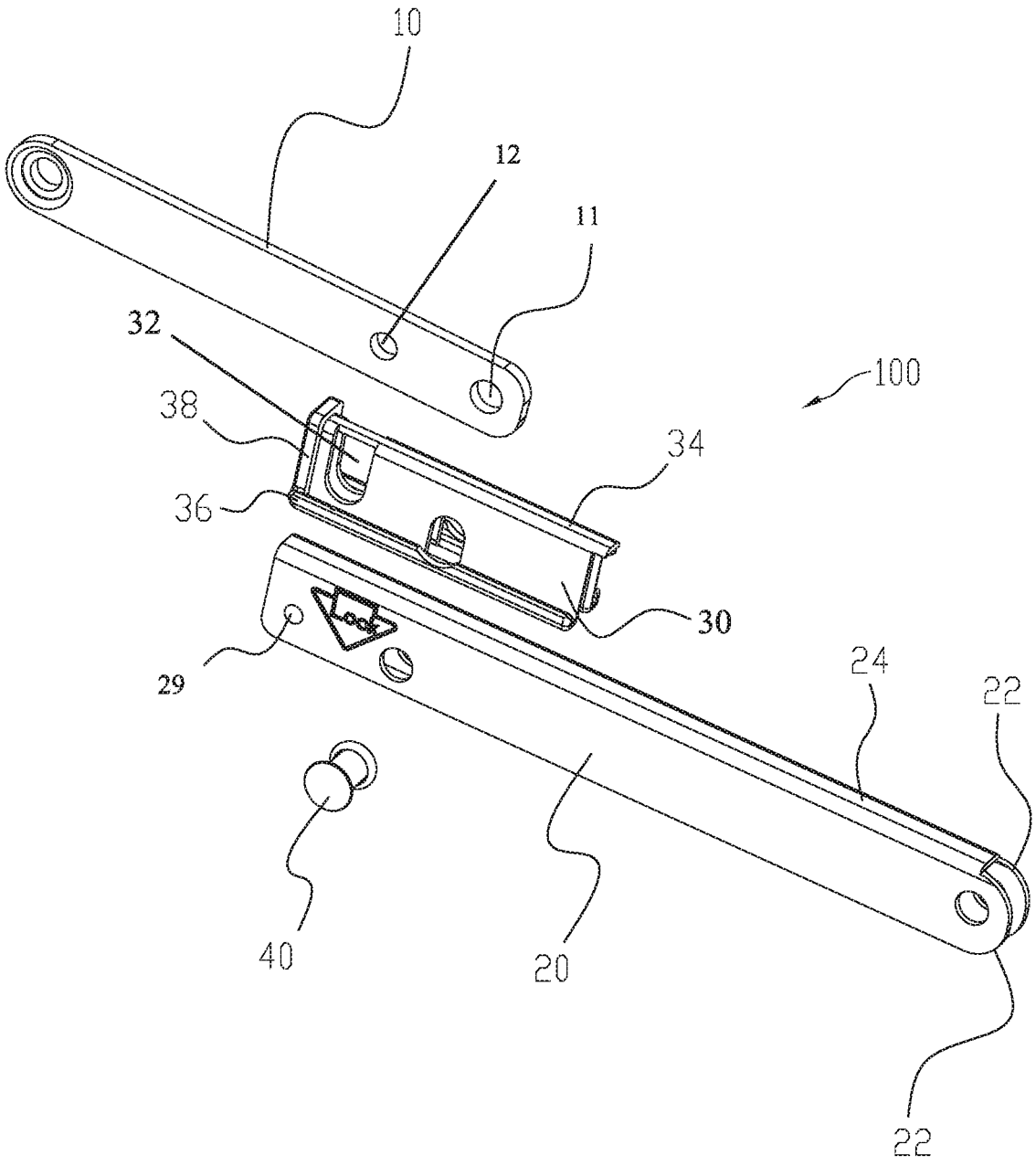
FIG. 2 illustrates an exploded view of the folding hinge of Embodiment 1 of the present disclosure.
Figure 3:
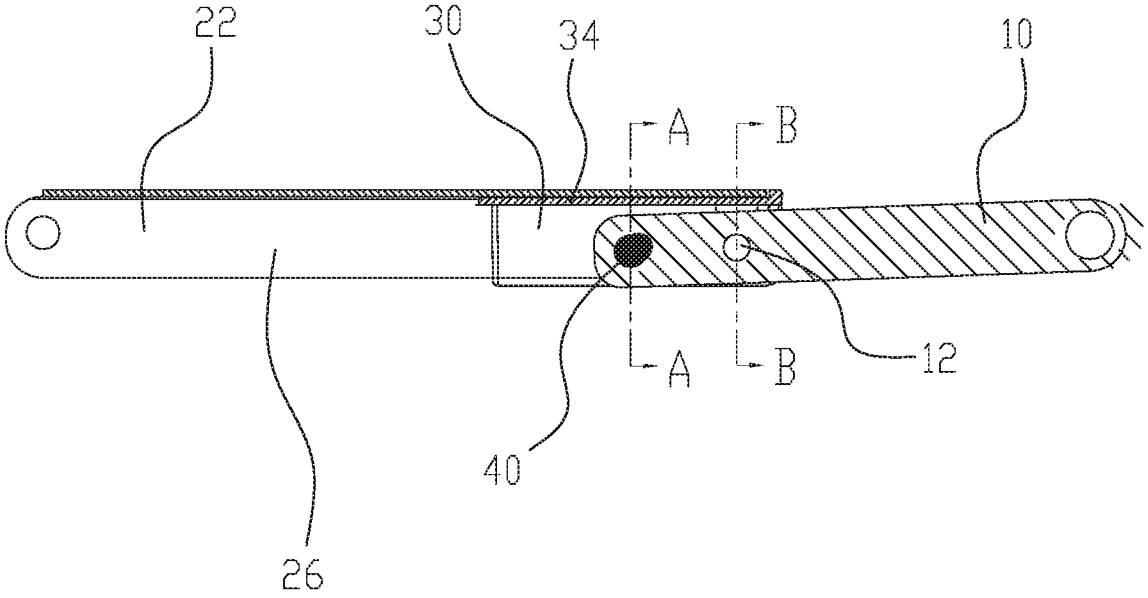
FIG. 3 is a cross-sectional view of the folding hinge of Embodiment 1 of the present disclosure.
Figure 4:
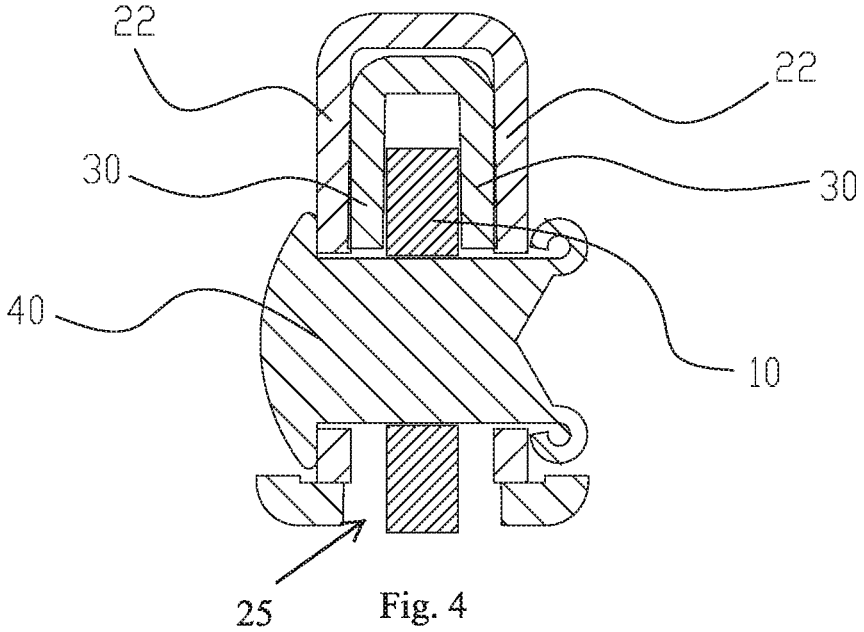
FIG. 4 is a cross-sectional view along a line A-A in FIG. 3.
Figure 5:
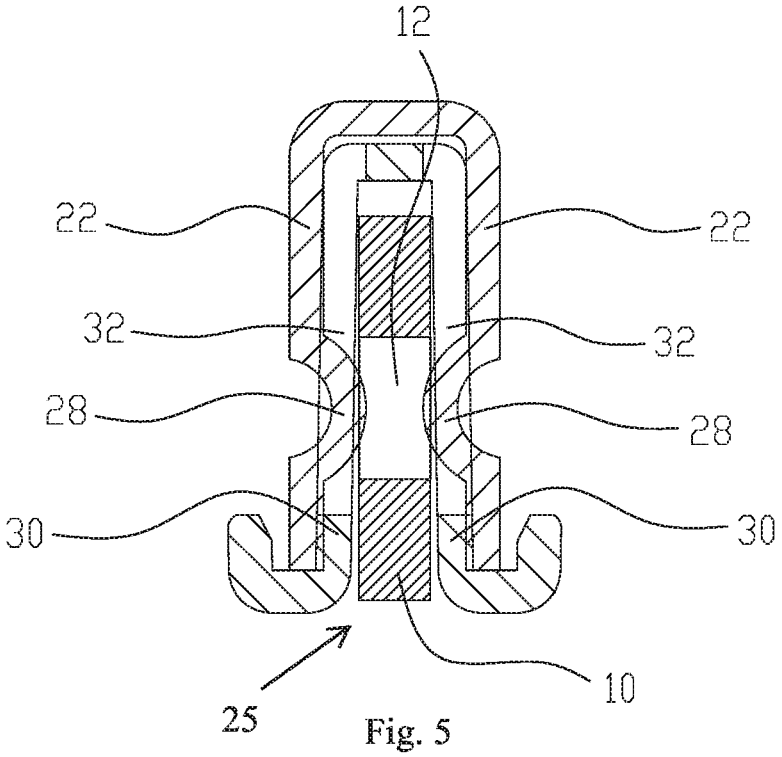
FIG. 5 is a cross-sectional view along a line B-B in FIG. 3.

Referring to FIG. 1, a folding hinge 100 of the present disclosure is connected between a table leg 200 and a table top frame 300 to enable the table leg 200 to freely rotate relative to the table top frame 300 for folding and unfolding.

Referring to FIGS. 2-5, the folding hinge 100 comprises an inner hinge piece 10 and an outer hinge piece 20. A cross-section surface (i.e., a surface substantially perpendicular to a longitudinal or longest surface) of the outer hinge piece 20 comprises a U-shaped structure 25. The U-shaped structure 25 of the outer hinge piece 20 comprises two side plates 22 bilaterally symmetrically disposed. Top edges of the two side plates 22 are connected together by a connecting piece 24. A slot 26 is defined between the two side plates 22. A first end of the inner hinge piece 10 extends into the slot 26 and is pivotally connected to the outer hinge piece 20 (i.e., a second end of the inner hinge piece 10 is configured to be pivotally connected to the table leg 200). The inner hinge piece 10 comprises a through hole 12. An end portion of an inner surface of each of the two side plates 22 respectively comprises a convex portion 28 (i.e., a rear end of the outer hinge piece 20 is pivotally connected to the table top frame 300), and an opposite side of the convex portion defines a concave portion 29. The two convex portions 28 are symmetrically disposed and are disposed to correspond to the through hole 12. The two convex portions 28 are clamped together through the through hole 12 so that the inner hinge piece is positioned between the two side plates 22 when the inner hinge piece 10 and the outer hinge piece 20 are unfolded. An inner surface of each of the two side plates 22 is respectively disposed with a plastic plate 30, and each of the two plastic plates 30 comprises a position hole 32 corresponding to a corresponding one of the two convex portions 28. Each of the two plastic plates 30 at least covers an area where a corresponding one of the two side plates 22 and the inner hinge piece 10 overlap when the inner hinge piece 10 and the outer hinge piece 20 are unfolded.

As the inner hinge piece 10 and the outer hinge piece 20 are metal elements, the inner side of each of the two side plates 22 is disposed with the plastic plate 30. The plastic plate 30 can separate the inner hinge piece 10 from the two side plates 22 and avoid side walls of the inner hinge piece 10 and the two side plates 22 of the outer hinge piece 20 from directly contacting each other. An unfolding operation and a folding operation become easier, and the inner hinge piece 10 and the outer hinge piece 20 can maintain a better damping effect and have a longer service life.

Top edges of the two plastic plates 30 are connected together by a plastic top wall 34. The two plastic plates 30 and the plastic top wall 34 define an injection-molded integral part. The injection-molded integral part is inserted into the slot 26 to achieve a convenient assembly.

A lower edge of each of the two plastic plates 30 comprises a flange 36 extending outward, and the flange 36 is fastened to a bottom edge of a corresponding one of the two side plates 22 so as to prevent a corresponding one of the two plastic plates 30 from loosening.

An end surface of each of the two plastic plates 30 and an end surface of the plastic top wall 34 facing the inner hinge piece 10 define a stop ring 38, The stop ring 38 abuts an end face of the outer hinge piece 20 to enable the position hole 32 to align with the convex portion 28, and positioning is easier.

Preferably, the inner hinge piece 10 (i.e., through a hole 11) is pivotally connected to the outer hinge piece 20 by a rivet 40.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A folding hinge, comprising:

an inner hinge piece, and an outer hinge piece, wherein:

the outer hinge piece comprises two side plates bilaterally symmetrically disposed, top edges of the two side plates are connected together by a connecting piece, a slot is defined between the two side plates, a first end of the inner hinge piece extends into the slot and is pivotally connected to the outer hinge piece, the inner hinge piece comprises a through hole, an end portion of an inner surface of each of the two side plates respectively comprises a convex portion and the two convex portions are symmetrically disposed, the two convex portions are disposed to correspond to the through hole, the two convex portions are clamped together through the through hole so that the inner hinge piece is positioned between the two side plates when the inner hinge piece and the outer hinge piece are unfolded, an inner surface of each of the two side plates is disposed with a plastic plate, each of the two plastic plates comprises a position hole corresponding to a corresponding one of the two convex portions, and each of the two plastic plates at least covers an area where a corresponding one of the two side plates and the inner hinge piece overlap when the inner hinge piece and the outer hinge piece are unfolded.

2. The folding hinge according to claim 1, wherein a cross-section surface of the outer hinge piece comprises a U-shaped structure.

3. The folding hinge according to claim 1, wherein:

a lower edge of each of the two plastic plates comprises a flange extending outward, and the flange is fastened to a bottom edge a corresponding one of the two side plates.

4. The folding hinge according to claim 3, wherein:

the two plastic plates are connected together by a plastic top wall, and the two plastic plates and the plastic top wall define an injection-molded integral part.

5. The folding hinge according to claim 4, wherein:

an end surface of each of the two plastic plates and an end surface of the plastic top wall facing the inner hinge piece define a stop ring, and the stop ring abuts an end face of the outer hinge piece.

6. The folding hinge according to claim 1, wherein the inner hinge piece is pivotally connected to the outer hinge piece by a rivet.

* * * * *